US007852234B1

(12) United States Patent
Borenstein et al.

(10) Patent No.: US 7,852,234 B1
(45) Date of Patent: Dec. 14, 2010

(54) CROSS-WALK SAFETY LIGHTING WITH MULTIPLE ENHANCED FLASH RATE

(75) Inventors: Steve Borenstein, Sacramento, CA (US); Kyle J. Owens, Elk Grove, CA (US)

(73) Assignee: Traffic Safety Corp., Sacramento, CA (US)

( * ) Notice: Subject to any disclaimer, the term of this patent is extended or adjusted under 35 U.S.C. 154(b) by 288 days.

(21) Appl. No.: 12/136,343

(22) Filed: Jun. 10, 2008

Related U.S. Application Data

(60) Provisional application No. 60/934,729, filed on Jun. 14, 2007.

(51) Int. Cl.
*G08G 1/07* (2006.01)

(52) U.S. Cl. ..... 340/925; 340/944

(58) Field of Classification Search ..... 340/925, 340/944, 309.16, 331, 332; 362/800
See application file for complete search history.

(56) References Cited

U.S. PATENT DOCUMENTS

| | | | | |
|---|---|---|---|---|
| 3,208,038 | A | 9/1965 | Jeffers | |
| 3,584,257 | A * | 6/1971 | Adams | 340/331 |
| 3,737,722 | A * | 6/1973 | Scharlack | 362/800 |
| 4,590,455 | A | 5/1986 | Fritzinger | |
| 4,843,337 | A | 6/1989 | Conn, Jr. et al. | |
| 5,790,017 | A | 8/1998 | Berryhill | |
| 6,257,375 | B1 | 7/2001 | Andras | |
| 6,259,375 | B1 | 7/2001 | Andras | |
| 6,317,052 | B1 | 11/2001 | Welling et al. | |
| 6,384,742 | B1 | 5/2002 | Harrison | |
| 6,398,399 | B1 | 6/2002 | Neophytou | |
| 6,515,584 | B2 | 2/2003 | DeYoung | |
| 6,597,293 | B1 | 7/2003 | Harrison | |
| 6,683,532 | B2 | 1/2004 | Peet, II et al. | |
| 6,683,540 | B1 | 1/2004 | Harrison | |
| 6,715,956 | B1 | 4/2004 | Weber et al. | |
| RE38,795 | E | 9/2005 | Welling et al. | |
| 7,046,160 | B2 | 5/2006 | Pederson | |
| 7,153,013 | B2 | 12/2006 | Pederson | |
| 7,234,892 | B2 | 6/2007 | Raaijmakers et al. | |
| 7,273,328 | B2 | 9/2007 | Hunter et al. | |
| 7,317,405 | B2 | 1/2008 | Green et al. | |
| 7,429,919 | B2 * | 9/2008 | Silic et al. | 340/539.1 |
| 7,688,222 | B2 * | 3/2010 | Peddie et al. | 340/332 |
| 2004/0075583 | A1 | 4/2004 | Chaffe | |
| 2004/0257214 | A1 | 12/2004 | Smithson | |
| 2005/0040970 | A1 | 2/2005 | Hutchins et al. | |
| 2005/0104747 | A1 | 5/2005 | Silic et al. | |
| 2005/0270175 | A1 | 12/2005 | Peddie et al. | |
| 2008/0018494 | A1 * | 1/2008 | Waite et al. | 340/944 |

* cited by examiner

*Primary Examiner*—John A Tweel, Jr.
(74) *Attorney, Agent, or Firm*—John P. O'Banion

(57) ABSTRACT

An apparatus and method for controlling cross-walk boundary lighting, such as multiple flush-mounted lights on the boundary, or boundaries, of a cross-walk. Enhanced flashing patterns are output in a primary output to drive cross-walk lighting to produce a different output pattern with each cross-walk activation. Enhanced flashing patterns comprise the output of multiple pulses of light (e.g., 2 to 5) with various pulse widths and timing during the ON portion of the light cycle. Selection is performed from a plurality of enhanced flashing patterns retained within a cross-walk lighting controller. One or more secondary outputs are configured to generate other patterns, in particular an output with a field selectable relationship and synchronization to the primary pattern, such as a matching pattern, a non-enhanced version, a non-enhanced complementary pattern, or a solid output for as long as the primary output is active.

20 Claims, 8 Drawing Sheets

CROSS-WALK SAFETY LIGHTING WITH MULTIPLE ENHANCED FLASH RATE

CROSS-REFERENCE TO RELATED APPLICATIONS

This application claims priority from U.S. provisional application Ser. No. 60/934,729 filed on Jun. 14, 2007, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to cross-walk lighting, and more particularly to an enhanced flash-rate controller for generating different multi-pulse light flash patterns.

2. Description of Related Art

Toward improving pedestrian safety, modern cross-walks are being configured with recessed lighting. Typically these systems are implemented with clusters of LED lights, generally deployed substantially flush with the roadway and having a lighting row on the approach side, or both sides, which border the cross-walk path. With the cross-walk indication viewable on the roadway surface, the driver is more likely to see the signal and thus yield to pedestrian traffic.

When a pedestrian desires to traverse the street, he/she presses a walk-button, or is otherwise detected (e.g., pressure-plate, voice, or similar detectors) and the cross-walk lighting is activated for a sufficient period of time to allow persons to cross.

Roadway lighting is then activated subject to an ON and OFF cycling (flashing) along the boundary of the cross-walk while the cross-walk is active. To further reduce incursions, the lights are often made to flash rapidly during the ON periods (referred to as multi-pulsed flashing), so that the lighting is more readily seen by oncoming drivers. The rapid flashing during the ON time period is known as enhanced flashing, and is subject to rate restrictions according to Manual on Uniform Traffic Control Devices (MUTCD) defining rates per minute of flashing (e.g., 55× or 60× times per minute).

However, despite these safety precautions pedestrians are still injured or killed as a consequence of inattentive drivers.

Accordingly, the present invention provides additional pedestrian safety for in-roadway cross-walk lighting and overcomes shortcomings of existing cross-walk lighting systems.

BRIEF SUMMARY OF THE INVENTION

A cross-walk lighting safety system is described herein utilizing a novel enhanced flash-rate controller that regulates driver warning lights which are distributed across the pavement at cross-walks. Aspects of the invention provide functionality which extend beyond the use of enhanced flash-rates for cross-walk lighting.

The object of the invention is to generate cross-walk flashing light patterns that drivers will more readily notice and not get "used to" by seeing the same pattern over and over. Numerous flashing patterns are produced by the controller for controlling boundary lighting, flashers, beacons and so forth. The plurality of flash times, periodic timing of flashes and breaks, and repetitions/combinations are all accessible through the subject controller. In one important mode the controller selects a different enhanced lighting pattern, from a plurality of enhanced lighting patterns (e.g., seven or more), in response to each activation of the cross-walk lighting system. Attention of the driver is thus more readily grasped and maintained and thus accident rates are reduced.

In order to provide a base for understanding, terms relating to a number of aspects of the present invention are generally defined below. The following terms are generally described in relation to the specification, and are not to be interpreted toward constraining specific recitations of the specification.

"Primary" output/pattern—At least one mode of the present invention provides multiple outputs each configured to support a pattern. These outputs can be set to output the same pattern, variants of the same patterns, or different patterns. In the context of multiple outputs, one output is considered the primary (Output A) with the output referred to as the primary pattern. By way of example, the choice of pattern configuration can be set by the user, such as in response to a programmed input, or hardwired input (e.g., pattern code switch).

"Secondary" output/pattern—A second output, or the pattern generated on that second output. It should be appreciated that the present invention can be configured to provide any desired number of additional outputs/patterns (e.g., tertiary) although these are generally subsumed under the term "secondary" output for the sake of simplicity of description.

"Flash Rate"—During activation, the lighting controller generates flashes for the cross-walk lighting. During conventional flashing the light is turned ON for a first portion of the cycle and then turned OFF for a second portion of the cycle. Typically these patterns are close to a 50% duty cycle at a rate of about one flash per second. According to traffic code regulation, such as Manual on Uniform Traffic Control Devices (MUTCD) guidelines, flash rates are defined at 50×, 55× and 60×.

"Enhanced" Flash—An enhanced form of flashing is provided in which during the ON periods of a cycle, the lights are driven by a multi-pulsed flash, wherein the lights are turned rapidly on and off during the ON period. During an enhanced flash pattern the light output is not output in a solid mode while ON, but instead is subject to a subpattern of rapid on and off transitions. Limits are imposed on the rate of the multi-pulsed flashing as given by various regulatory guidelines.

"No-Enhanced" Flash (NOE)—During "no enhanced" flash, also referred to as solid flashing, the lights remain ON during the ON portion of the flash cycle, and is defined in MUTCD as a steady (solid) flash. In one mode this flash type refers to a non-primary output (e.g., secondary), and is an output synchronized with the primary flash but without the enhanced flashing.

"NOE compliment"—A pattern following the complement (opposite) of the NOE pattern is output, such as can be used for so-called "wig-wag" lighting applications, wherein light appears to be wagging from one location to another in a back and forth format.

"Activation Period"—This is the period during which the lighting patterns are active for the cross-walk lighting. Time duration is controlled by the present cross-walk lighting controller. In another aspect the warning light duration can be modulated by a traffic control system to provide assurance that crosswalk lighting is synchronized with other intersection lighting. Activation may also arise over long periods of time, such as in emergencies, events and so forth, wherein the controller is set to maintain activation until deactivated, such as by manual intervention.

Returning now to a brief description of functionality, the invention is amenable to being embodied in a number of ways, including but not limited to the following descriptions.

The lighting controller is configured to support numerous flashing patterns which are determined by the controller and output to the primary output, and to secondary outputs as desired. The pattern to be output in response to cross-walk activation is selected by the cross-walk lighting controller based on a set sequence, or in response to modified random selection.

In one mode of the invention, sequential pattern selection is utilized in which the lighting controller selects the next in a series of enhanced patterns within a retained plurality of patterns, such as seven or more. Accordingly, a different pattern is selected with each cross-walk activation, toward arresting driver attention and thus increasing safety.

In another mode of the invention, random (or pseudo-random) pattern selection is utilized in which the enhanced lighting pattern is selected from a plurality of patterns retained in the cross-walk lighting controller and in response to a random selection process. In this way even the sequence of patterns from one activation to the next is not discernable while the approach retains the advantage of selecting from a known set of patterns which assures proper compliance to applicable regulations and other advantages.

In one aspect of the random selection mode, a history lockout mechanism is used to assure that the most recent "N" patterns are not repeated. For example, with the most common setting of N=1, a random selection of pattern is made and compared with the previous 1 pattern output, if a match is found then another random selection is made. In this way the system assures that the same pattern is not output consecutively. The selection of next pattern can be performed by the controller in preparation for the next activation or at the time of activation.

In another mode of the invention, the selection of a pattern can be influenced in response to external inputs, such as temporal considerations. For example, the data from a real-time clock can be manipulated and utilized as a pointer into a plurality of patterns. The data can be used by itself to direct selection, or more preferably in combination with other pattern selection criterion. By way of operational example, and not by way of limitation, the enhanced cross-walk lighting pattern being output on Monday at a given time period differs from that output on Tuesday, or Wednesday and so forth. In one implementation, random pattern selection is utilized with a history mechanism that also takes into account similar time periods in recent days so as to provide quasi-unique patterns.

The use of pre-stored patterns has advantages in that they are (1) more readily tested, (2) can be assured to conform to applicable regulations regarding flash rate, (3) can be optimized for viewing wherein certain wholly random patterns would not direct sufficient attention over their duration, and (4) they do not pose a contemplative distraction. In regards to this last consideration, the use of encoded patterns, such as encoding of time, temperature, or headlines (e.g., in a Morse code sequence or other encoding format, ASCII, EBCDIC, and for forth) could prove a distraction to an astute driver attempting to decipher the pattern. However, the invention can be less preferably configured to output patterns in response to coding of a temporal selector or other metric.

In one implementation of the invention, the lighting controller outputs at least a first and second set of outputs for controlling the activation and deactivation of the lighting devices along the path of the cross-walk and related signs and signals. The patterns generated on secondary outputs can be according to a separate pattern or a pattern which is based on the primary pattern, such as its complement, a non-enhanced flash version of the primary or its complement, or similar variations in relation to the first set of outputs. For example, with the primary output connected for enhanced pattern output on in-roadway lighting, then the secondary output may be set as a non-enhanced complemented version of that pattern which is sent to drive sign beacons, cross-walk signs and so forth.

The lighting controller of the present invention is configured to allow field personnel to readily set, test and control aspects of cross-walk lighting. For example, aside from setting patterns and pattern modes, the activation duration, plurality of flash times, periodic timing of flashes and breaks, and repetitions and/or combinations are all accessible via the subject controller.

One implementation of the invention is an apparatus for controlling cross-walk boundary lighting, comprising: (a) means for detecting an activation signal for a cross-walk configured with cross-walk boundary lighting; (b) means for selecting a different enhanced flashing pattern, from a plurality of patterns stored in the apparatus, for each successive activation of the cross-walk boundary lighting, wherein the enhanced flashing pattern comprises the output of multiple pulses of light (e.g., about two to five) during each ON portion of flashing pattern; (c) means for changing one or more lighting output signals, including a primary lighting output, responsive to the selecting of an enhanced flashing pattern; (d) means for determining that an activation period for the cross-walk boundary lighting has expired; and (e) means for deactivating the one or more lighting output signals at the expiration of the activation period.

In one preferred implementation, the apparatus includes means for changing one or more secondary lighting outputs which are synchronized with and have a field selectable relationship with the primary lighting output.

The apparatus can be configured to work with any form of cross-walk activation device, wherein the means for detecting an activation signal for a cross-walk is configured to receive input from a push-button or other active cross-walk activation device requiring user interaction (e.g., switch, capacitive touch/proximity sensor), or from a passive cross-walk activation device (e.g., sensor, pressure plate, voice activation, infrared sensor, ultrasonic sensor, laser sensor, and so forth), or by receiving an activation signal from a control unit configured for controlling traffic control signaling which intermediates the cross-walk activation and maintains synchronization with all devices.

One implementation of the invention is an apparatus for controlling cross-walk boundary lighting, comprising: (a) a cross-walk lighting control module configured for receiving a cross-walk lighting activation signal; (b) the cross-walk lighting control module configured with at least one output signal for driving the activation of lighting along the path of the cross-walk; (c) the cross-walk lighting control module comprising a computer and memory adapted for storing and executing programming adapted for, (c)(i) selecting a different flashing pattern, from a plurality of internally stored enhanced lighting patterns, for each successive activation of cross-walk lighting, (c)(ii) changing one or more lighting output signals responsive to the selected pattern, and (c)(iii) deactivating the one or more lighting output signals at the termination of the selected pattern.

In one mode of the invention, the enhanced flashing pattern is selected sequentially from a plurality of patterns stored within the cross-walk lighting control module. In another mode the flashing pattern is selected according to a randomized (e.g., random or pseudo random) selection, from a plurality of patterns stored within the cross-walk lighting control module. Programming prevents the output of patterns which have been most recently used (e.g., last pattern as default or made selectable from last 1 to N patterns output) and making a new selection in response thereto.

The present invention provides a number of beneficial aspects which can be implemented either separately or in any desired combination without departing from the present teachings.

An aspect of the invention is a cross-walk lighting controller which controls activation and lighting patterns for at least one set of cross-walk lighting devices.

Another aspect of the invention is a cross-walk lighting controller that can operate independently with input from cross-walk activation buttons or similar input devices, or in cooperation with a traffic control system.

Another aspect of the invention is a cross-walk lighting controller that is configured for compliance with MUTCD as well as state regulations.

Another aspect of the invention is a cross-walk lighting controller that is particularly well suited for cross-walk environments which include flush mounted in-roadway lights, while simultaneously supporting additional lighting devices, such as beacons, signs and so forth.

Another aspect of the invention is a cross-walk lighting controller that supports activation from push-buttons, talking push-buttons, or pedestrian sensors.

Another aspect of the invention is a cross-walk lighting controller that supports activation at the controller unit for testing and operating purposes.

Another aspect of the invention is a cross-walk lighting controller that provides field selectable activation duration, such as from 1-99 seconds.

Another aspect of the invention is a cross-walk lighting controller that provides field viewable readouts for both pattern selection and selected activation duration.

Another aspect of the invention is a cross-walk lighting controller having displays which automatically dim after a sufficient (e.g., fixed time) period of inactivity toward conserving power.

Another aspect of the invention is a cross-walk lighting controller that provides field viewable visual indicators for push-button input, system activation, primary output and secondary output(s).

Another aspect of the invention is a cross-walk lighting controller that provides a field selected "extend option" to allow, or disallow, re-triggering of the activation period, thus extending its time period.

Another aspect of the invention is a cross-walk lighting controller that provides a field selectable activation over-ride switch for enabling constant-on activation (e.g., well suited for street closures such as during special events).

Another aspect of the invention is a cross-walk lighting controller having programming in which is retained a plurality of flash patterns which may be selected for output to control cross-walk lighting.

Another aspect of the invention is a cross-walk lighting controller which provides field selectable enhanced flash patterns and/or pattern mode settings.

Another aspect of the invention is a cross-walk lighting controller that displays the selected enhanced flash pattern or flash pattern mode on a field viewable display.

Another aspect of the invention is a cross-walk lighting controller having flash patterns and pattern modes which can be configured as being conditionally responsive, such as to a temporal selector, ambient light level, condition of lighting units and ECB, and other internal or external characteristics which can be registered by the ECB device.

Another aspect of the invention is a cross-walk lighting controller which provides field selectable secondary outputs.

Another aspect of the invention is a cross-walk lighting controller having secondary outputs which are configured to output a pattern with a field selectable relationship to the primary pattern.

Another aspect of the invention is a cross-walk lighting controller which is configured for wired or wireless communication with remote traffic devices and so forth.

A still further aspect of the invention is the ability to log activity of the cross-walk lighting control circuit over a desired period.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 10. It will be appreciated that the apparatus may vary as to configuration and as to details of the parts, and that the method may vary as to the specific steps and sequence, without departing from the basic concepts as disclosed herein.

The enhanced cross-walk lighting controller provides power to cross-walk lighting fixtures, according to programmed duration and flash sequences. The lighting controller provides numerous features which extend beyond that of current designs, including multiple enhanced patterns and output configurations, user programmable duration and settings, and dual outputs with configurable relationship.

Figure 1:
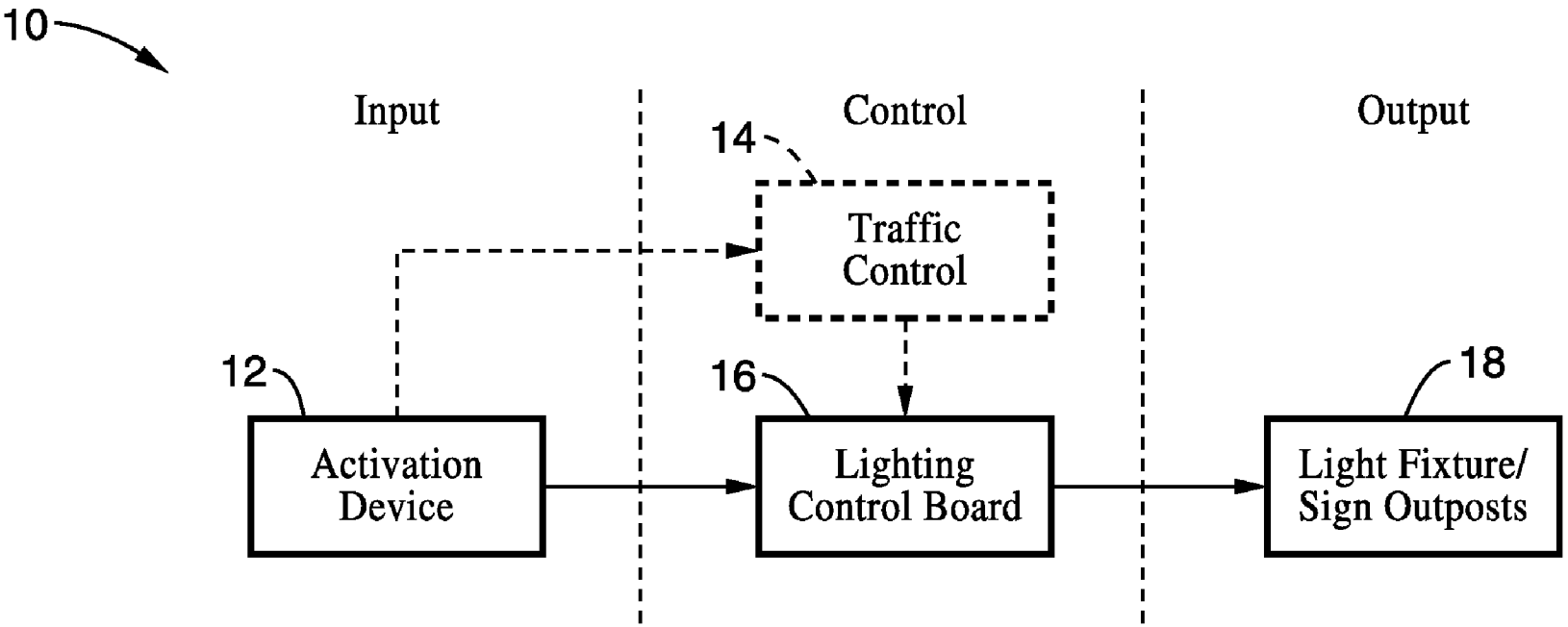
FIG. 1 is a block diagram of a cross-walk control system according to an embodiment of the present invention.

FIG. 1 illustrates an example embodiment 10 of a cross-walk safety system wherein an enhanced control board (ECB) 16 is connected within a cross-walk traffic safety system. In this simplified block diagram a cross-walk push-button, or other activation device (e.g., Ped-X-Pads®), 12 is shown as an input connected to lighting control board 16 to which is connected lighting devices 18 to be controlled for the cross-walk. The cross-walk lighting devices 18 may comprise multiple in-roadway lighting elements (e.g., flush, or substantially flush, to the roadway near or along the boundary of the cross-walk) and optionally other light devices, such as beacons and sign outputs. At a stand-alone cross-walk, the lighting controller is all that is necessary for controlling all safety lighting for the given cross-walk. It will be appreciated that at light-controlled intersections, the cross-walk lighting controller of the present invention operates in coordination with the traffic control lighting. An optional traffic control system 14 is thus shown in FIG. 1 for receiving a cross-walk activation "request" from input 14, wherein according to appropriate light timing, unit 14 generates an activation signal for the enhanced control board 16 to control cross-walk lighting.

Figure 2:
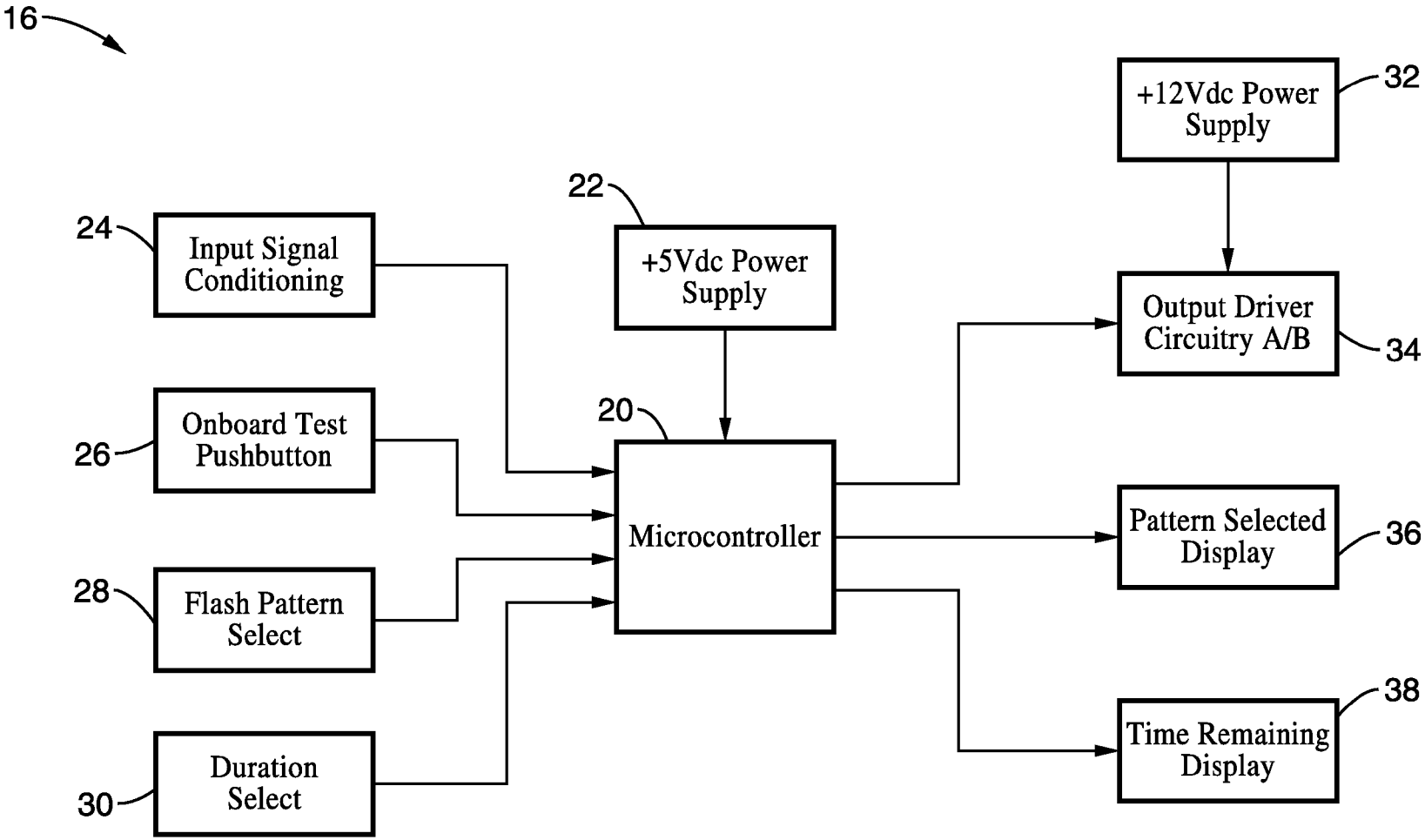
FIG. 2 is a block diagram of a cross-walk lighting controller according to an embodiment of the present invention.

FIG. 2 illustrates an example embodiment 16 of the enhanced control board (ECB) and a number of its functional blocks. A control circuit 20 is exemplified as a microcontroller for controlling the actions of the device. The circuitry of the system is shown powered by power supply 22, shown for the sake of simplicity connected to the microprocessor and exemplified as being a +5V power supply. Input signal conditioning 24 is shown for protecting the input circuits from spikes and transients and optionally filtering unwanted noise from the signal inputs. An onboard test block 26 with optional onboard test push button is shown for performing checks of the ECB circuits, errors from which can be displayed in any desired manner by microcontroller 20. A flash pattern selection block 28 is shown which selects the desired flash pattern or pattern mode for the ECB device. A duration selection block 30 is shown for controlling the duration of the cross-walk lighting sequence. In block 32 another power supply is shown to provide drive voltage to an A/B output driver circuit block 34. The use of higher voltages for the driver circuits allows for brighter light outputs and reduced power losses. A display block 36 is shown for outputting information about the flash pattern, while another display block 38 is shown for outputting the time remaining in the cross-walk lighting sequence.

Figure 3:
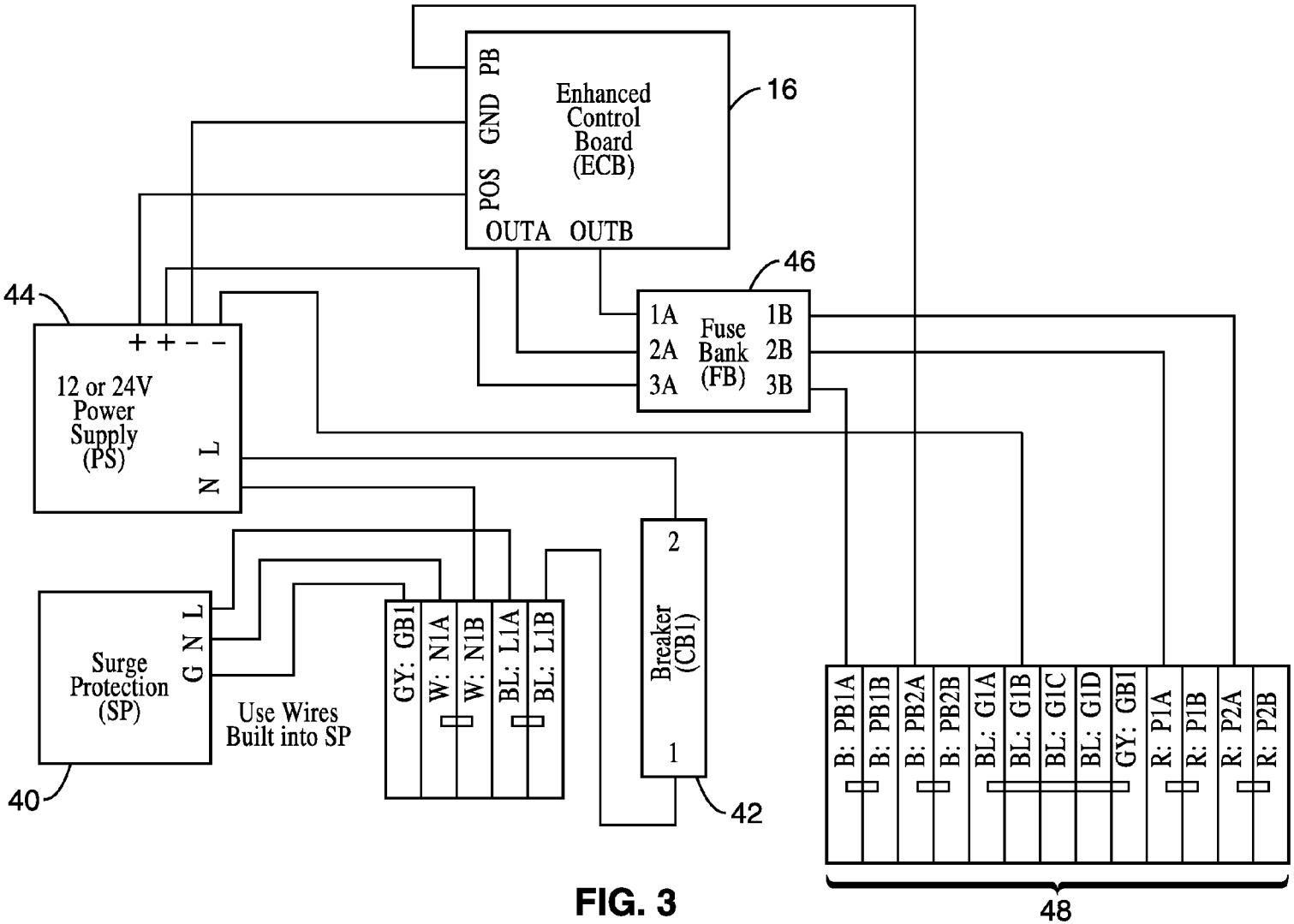
FIG. 3 is a block diagram of representative panel connections for a cross-walk lighting controller according to an aspect of the present invention.

FIG. 3 illustrates a power connection diagram. A housing is shown containing AC power circuits, including surge protection 40 and a number of circuit breakers including breaker 42 for supplying power to a power supply 44 configured for outputting one or more DC power levels to the operating circuit and lighting of the cross-walk lighting system. ECB circuit 16 is shown connected for receiving power from power supply 44 and for outputting at least one light drive signal, although two are shown in a preferred configuration. Light drive output signals are shown connected through breakers 46, 48.

Figure 4:
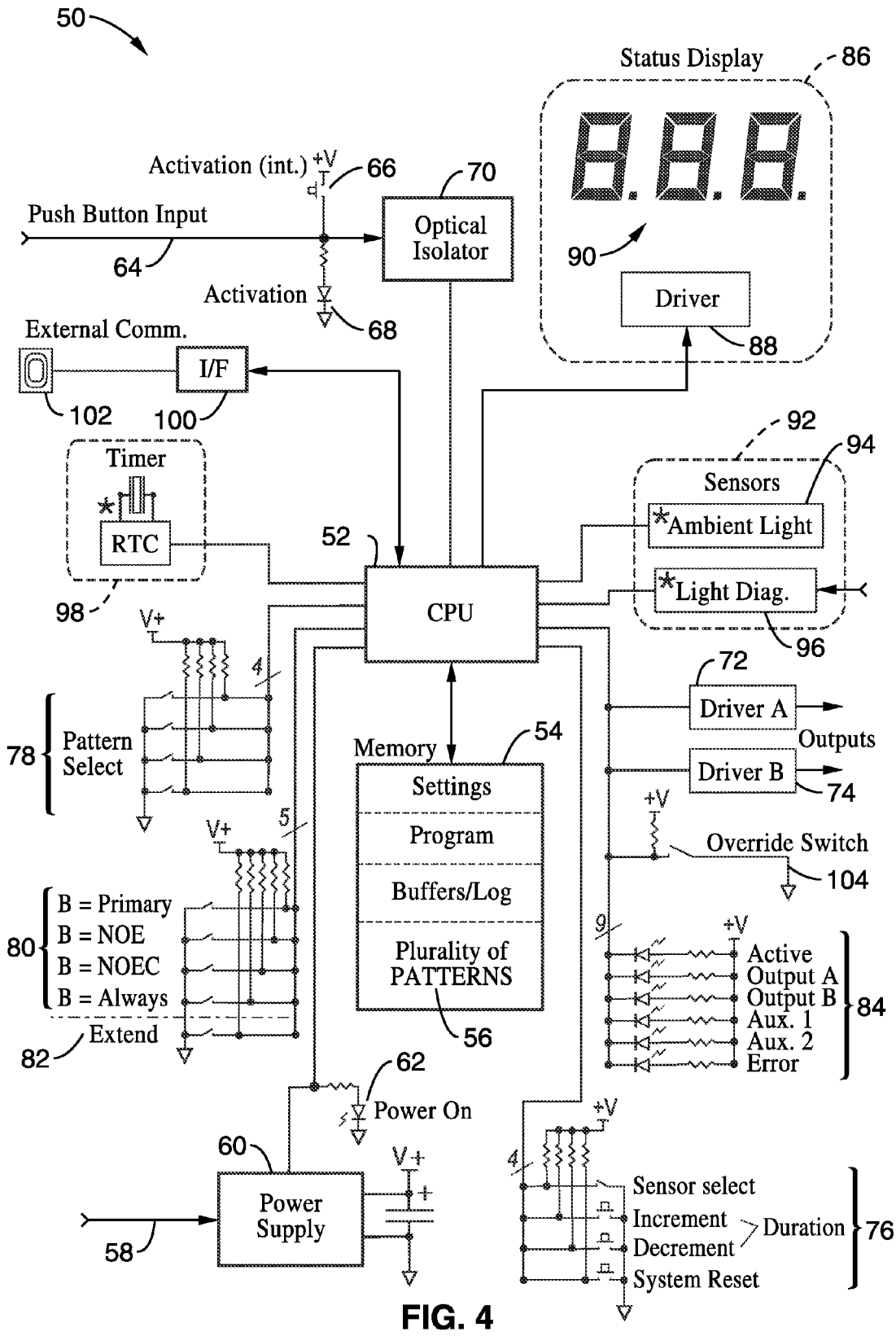
FIG. 4 is a schematic diagram for a cross-walk lighting controller according to an embodiment of the present invention.

FIG. 4 illustrates a more detailed diagram of an embodiment 50 for an ECB circuit according to the present invention. This embodiment 50 utilizes a number of field selectable features and the ability for status and other information to be viewed in the field. At least one central processing unit (CPU) 52 is shown with associated one or more memory circuits 54. The system is configured to properly return back to operation after power disruption without the need of reprogramming. Programming is retained in the memory for execution on the CPU (e.g., microcontroller, microprocessor, or other sequential control circuits) to control the operations of the ECB. Memory 54 is configured to retain programming as well as settings, buffers, activity log, and a plurality of cross-walk flash patterns 56, which will be discussed later in more detail. The activity log is preferably adapted to register the activity of the cross-walk and optionally field activity at the controller. These events can be registered as a tally, but more preferably as an event log containing event along with date and time, from which tally information can be collected as desired. In this way one can assess both the cross-walk activity patterns or assess the timing of when a certain configuration of the ECB was set. It will be appreciated that the present invention can be configured with or without such logging.

Power is supplied (e.g., 110 VAC, 220 VAC, solar power, and so forth) externally 58 to a power supply 60, whose output powers the ECB. For simplicity only a single power output is shown although the drivers and other portions of the circuit preferably operate from higher voltage levels. A power-on indicator 62 is shown by way of a simple LED circuit. The operation of the ECB circuit is activated in response to receiving external input 64 from a pushbutton, or in response to manually generating an activation signal in the field (e.g., for testing) by pressing button 66. Activations received externally, such as from a cross-walk push button, or internally from the field testing/manual activation button, are shown on indicator 68, depicted as a simple LED circuit. As the input signal 64 may contain transients an optical isolator 70 is shown for protecting CPU 52. In this example a first driver A 72 is shown for outputting the primary flash signal, while a single secondary output B 74 is shown for outputting a secondary flash signal. It should be appreciated that the system can be implemented to support more than one secondary output, as desired for a given application.

In a preferred embodiment output A and output B are configured to operate lighting from one or more desired voltages (e.g., selecting a driver for either 12 VDC or 24 VDC) and are capable of supplying sufficient power to operate a safe lighting system (e.g., 10 A or greater) while providing transient/noise protection and sufficient thermal protection.

The ECB circuit also supports a number of control inputs and status outputs, the following being given by way of example, and not by way of limitation. It should also be appreciated that although exemplified in one form, such a switch or button, inputs may be received in a variety of forms (e.g., knobs, slide controls, keypad, from remote interfaces, and so forth) without departing from the teachings of the present invention.

A group of inputs 76 is shown in FIG. 4 for controlling sensor selection, duration control, and system resets. The sensor selection control is representative of selecting optional sensor functionality; thus a single switch is representative of selecting operation and/or functionality for any desired number of optional sensing devices, or similarly for controlling optional output functions. The increment and decrement inputs are configured for field selection of the activation duration, such as from between 01 and 99 seconds, or any desired duration range. The system reset button is used for resetting the controller, such as in response to an error condition, or to reset aspects of the system back to an original baseline condition.

Before proceeding to discuss additional elements of FIG. 4, the following discusses the use of enhanced and non-enhanced forms of flashing. The term flashing, or solid flashing, involves outputting an ON/OFF sequence of lighting in which each light is ON or OFF from between near 100 mS to 600 mS. Flash patterns used in the present invention conform to MUTCD specifications which require the flash rate to be between 50-60 flashes per minute (FPM). For example in a standard MUTCD 60× flash pattern the output is toggled in a 50% duty cycle with the light on for 500 mS then off for 500 mS and so forth.

To increase driver recognition, in-roadway flash patterns at cross-walks are typically generated using enhanced flash patterns, wherein during the ON period a multi-pulsed flash is generated. MUTCD allows a multi-pulsed flash (Enhanced Flash) in place of a single flash, as long as the multi-pulsed flash does not exceed 5 flashes per second (due to the possibility of causing epileptic response). For example during a 500 mS ON time, the light may be pulsed on up to five times, wherein a number of different patterns can be supported. In one implementation, the present invention utilizes enhanced flash patterns with 600 mS of ON time within which two to four light pulses are output with various widths and timing, and a 400 mS OFF time.

An input 78 is shown for selecting the pattern and/or pattern mode to be output. Selecting a pattern involves selecting a fixed pattern which is repeated with each activation. In addition, the present invention supports pattern modes in which different output patterns are output according to a given pattern mode, such as sequentially or randomly selecting and outputting patterns from a plurality of patterns defined in memory, in response to cross-walk activation.

By way of example, a series of four switches (e.g., DIP-switches) are shown for selection (e.g., in binary) any of up to sixteen patterns or pattern modes; however, it will be appreciated that different input selectors can be similarly utilized, such as switches, rotary encoders, linear encoders, thumbwheels, screwdriver adjustable switches, such as encoding decimal (BCD) or hexadecimal selectors, or other means for registering a user pattern selection. Sufficient pattern selector inputs can be provided to support any desired number of pattern and pattern mode selections.

According to one implementation, a finger or screwdriver adjustable rotary 0-15 hex encoder switch is utilized for selecting pattern or pattern mode. By way of example, codes 0-8 on the encoder may provide for selection of a single solid or enhanced pattern to be output for each and every cross-walk activation. The remaining codes in this example are utilized for selecting a pattern mode which changes the pattern for each activation, such as in response to patterns stored within the system. By way of example and not limitation, one mode is a sequential pattern mode in which the stored enhanced lighting patterns are selected sequentially for output with each activation of cross-walk lighting. In another pattern mode, a random mode can be selected in which patterns are randomly output for each successive activation. In one implementation, the random mode incorporates a history lockout mechanism which precludes the same pattern from being output twice in succession (or for preventing repeats further back as desired according to a value of N). The history lockout can be performed on the random selection mode, or in a separate mode as desired.

Additional modes may also be supported by the present invention, wherein the selection of the order of the patterns is determined, and/or the selection of pattern subsets is determined, such as selecting a subset of 'fast' patterns as opposed to 'slower' patterns with fewer ON state transitions. In addition, mode selection can be performed for alternating between one or more patterns. In one example, a pattern sequence list is populated, for instance by selecting a pattern (e.g., setting the encoder switch) and entering it into the sequence memory (e.g., toggling the extend switch to the opposite state and back, or use of other input). In alternate implementations, one or more additional pattern input selector(s) can be utilized to allow the user to set sequences or alternating patterns wherein the multi-pulsed flash varies on each cycle or N cycles. In addition, in at least one implementation, the pattern mode can be utilized for selecting a generated sequence in which the multi-pulse flash changes during a single activation period, for example a mathematical sequence, random sequence, and so forth which can be output while still adhering to MUTCD guidelines.

The ECB circuit is preferably configured for outputting at least two different outputs, described as primary and secondary, or as output A and output B. It should be appreciated, however, that different implementations of the present invention can provide more than one secondary output with different relationships to the primary without departing from the teachings of the present invention. Another group of inputs 80 is shown in the figure for indicating to the CPU how the secondary outputs from driver B 74 are to be controlled in a selectable relationship with the primary output from driver A 72. The secondary output can be set to coincide with the primary output, or to output a variation of the primary, such as a non-enhanced version, a non-enhanced complement and so forth. This aspect of the system is important in that there is often a need to control auxiliary lighting, such as cross-walk signs, or beacons, in concert with control of enhanced flash patterns for in-roadway lighting.

For simplicity of display, the present invention encodes only four alternatives within the four switches, wherein closing more than one switch results in an error condition (or access to variants or special testing modes). However, it will be appreciated that the system can be configured to allow any desired number of choices for output B, and that various input selectors can be alternatively utilized (e.g., 4 position slide switch selector, rotary encoders, and the like) which provide the desired number of selections. Selection of output B relationship with the primary output is discussed at length in regard to the waveforms of FIG. 7.

Another input 82 is shown labeled "Extend" which is configured to alert the CPU whether or not to extend the activation interval in response to additional cross-walk button presses. In a normal mode (switch=OFF), once the cross-walk is activated, it will remain active for the selected duration and then cycle off, even if the cross-walk button is pressed during the activation interval. However, if "Extend" is selected (switch=ON), then the activation interval is reset to full duration with each press of the cross-walk button, thereby extending the activation interval insofar as persons are still pressing the button in order to use the cross-walk.

Embodiments of the ECB circuit may also support any desired number of field discernable outputs (optical and/or audio). One group of optical indicators is represented by LED block 84. One indicator in this group of indicators depicts whether the cross-walk lighting is active, another follows the output of Output A, while another follows Output B. Additional indicators are shown by way of example for representing multiple auxiliary conditions (e.g., sense inputs, settings, warnings, and so forth), and the presence of at least one error condition. Additional outputs are represented for the ECB circuit with at least one display device 86 driven by a driver 88. Status information can be displayed to field personnel on display 86, such as for displaying activation duration, selected pattern or pattern mode, outputting interface feedback, outputting additional status, checking performance of the device and so forth. One such display is exemplified as a simple seven-segment numeric display, depicted as having three digits 90. In one mode of the invention, a single digit normally displays the pattern selection, while the other two digits constantly display the activation duration (e.g., duration setting, and remaining duration during an activation sequence). In a preferred embodiment power is saved as the displays time out after a given period with no input activity. In one alternative implementation a sensor on the ECB (e.g., mechanical switch, electric field sensor, optical sensor, or similar) detects when the ECB is being accessed by field personnel at which time it activates the status lighting, which can remain active while ECB is being accessed.

Cross-walk lighting control according to the present invention may also be configured for outputting patterns in response to other conditions, such as temporal state, ambient light conditions, and the state of the lights being activated, among others. It has already been discussed how the lighting pattern can be influenced by a temporal modifier, wherein it will be appreciated that other conditions may also influence the output of the ECB circuit. In this example, two optional sensors 92 are exemplified as "Ambient Light" 94 and "Light Diagnostics" 96. The pattern being output, as well as the control of drivers A and B may be modified in relation to the level of ambient lighting, so as to match the characteristics of the pattern with the ambient light condition. Similarly, ECB circuit operation can take into account diagnostic information from the lighting units as desired, such as altering a pattern in response to a reduced number of available light elements within one or more of the individual light units. A temporal element 98 is shown by way of a timer, such as a real-time clock (RTC) circuit, which provides information to aid in activity logging, as well as for influencing the output of the controller, including pattern outputs.

At least one optional external communication connection may be incorporated within the present invention. In one aspect a set of terminals is configured for interfacing with optional devices, for example including contacts for: power, push button input, extend/retrigger Input, outputs A and B, and optionally any other desired signals.

Furthermore, additional communication capability can be provided, such as to other lighting units, other traffic control circuits and so forth. By way of simple illustration the communication connection is shown by way of example comprising an interface 100 and external connector 102. It will be appreciated that this communication connection may be coupled to a wireless transmitter, receiver, or transceiver, for communicating wirelessly with other lighting units or traffic control circuits. In this manner the functionality and compatibility of the ECB circuit can be extended to suit additional target configurations. For the sake of illustration, presume it is desired to control a remote beacon on the approach to a cross-walk, but it is not desired to wire the connection, and the remote unit selected does not have a transmitter compatible with the driver outputs; wherein the programming can support any desired form of external communication through the external communication connection. It will also be appreciated that the communication connection can be utilized for logging, control or synchronization purposes as desired without departing from the teachings of the present invention.

An override switch 104 is shown for field selectable setting of the cross-walk lighting into an active mode. During emergencies, special events, and so forth when the roadway is not subject to normal traffic it is often convenient to select the override mode so as to keep cross-walk lighting in the active mode. In one implementation the display will read "On" while the ECB is in the override mode, and in one ECB configuration the display does not time out and turn off during override since the ECB unit is considered active.

Figure 5:
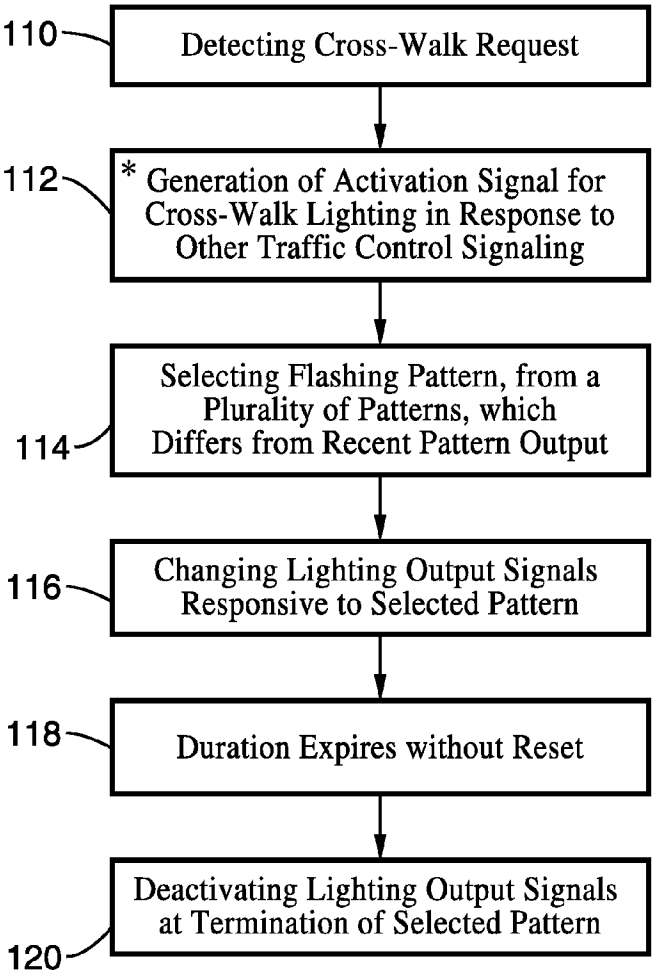
FIG. 5 is a flowchart generally depicting cross-walk lighting control according to an aspect of the present invention.

FIG. 5 illustrates an embodiment of a cross-walk boundary lighting method according to the invention. In block 110 a cross-walk request is detected, such as from a button, mat, or at least one activation input device. It will be appreciated that in some applications, the cross-walk request is intermediated by additional traffic control circuits, which is represented in optional block 112, so as to assure synchronization between all signals. In block 114 the system selects a flashing pattern from a plurality of stored patterns, wherein the pattern differs from the pattern output during the last activation of the cross-walk. Depicted at block 116, the output lighting is modulated in response to the pattern selected toward controlling the lighting, such as of in-roadway lighting and ancillary lighting of signs and so forth. Then in block 118 the cross-walk interval expires and has not been reset, such as in response to pressing the cross-walk request button when the extend button is in the ON position. Finally, in block 120 the ECB circuit deactivates the lighting output signal as this activation of cross-walk lighting is complete. In at least one implementation of the invention, when the pattern is being selected with each activation, the programming can be configured to determine the next pattern to be used prior to receipt of the next activation (although the time required to make a selection is only on the order of microseconds).

Figure 6:
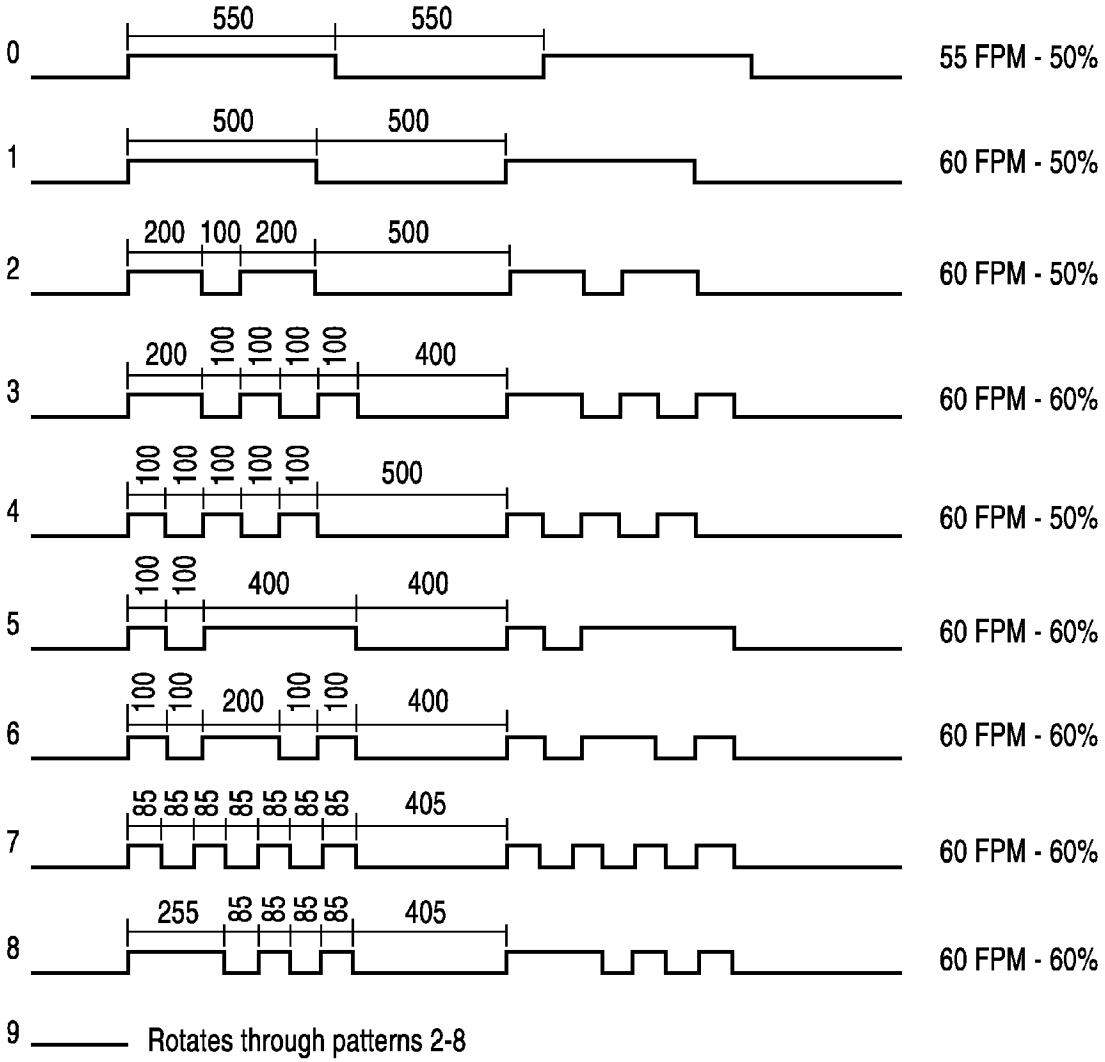
FIG. 6 are digital waveforms for a plurality of enhanced flash patterns from which a different pattern is selected for each cross-walk activation according to an aspect of the present invention.

FIG. 6 illustrates an example of solid and enhanced lighting patterns utilized according to one embodiment of the present invention. In the following implementation a 0-9 encoder switch is utilized for selecting pattern or pattern mode. In this example "0" defines selection of a 55 Flashes Per Minute (FPM) solid flashing pattern, which is a MUTCD standard, and has a 550 mS ON time and 550 mS OFF time. Similarly, another MUTCD pattern is selected with input of a "1" to obtain a 60 FPM solid flashing pattern with a 500 mS ON time and 500 mS OFF time. Inputting values of "2" through "8" then allows selecting from seven different enhanced flash patterns. By way of example each of these patterns provides a 60 FPM pattern having a 50-60% duty cycle. To illustrate the concepts, the ON and OFF timing for each of the described patterns is shown in the figure. In pattern "2" it is seen that the light is activated in the ON portion for 200 mS then is OFF for 100 mS followed by another activation of 200 mS within the ON period. The other patterns follow similar timing with the minimum ON or OFF pulse for this implementation being 85 mS, a pulse width which is viewer discernable (e.g., non-blending).

Selection of code "9" selects a sequential mode in which each of the seven enhanced lighting patterns (e.g., "2"-"8") is selected sequentially in response to a cross-walk activation. For instance pattern "2" is output on the first activation of the cross-walk, pattern "3" output on the next activation, pattern "4" on the next activation, and so forth. The sequence may select from the patterns in any desired fixed order, sequence, and/or direction.

It has been generally discussed that within any given cross-walk environment additional lighting devices may be driven by the lighting control system. Toward efficiently supporting real-world safety, the present invention preferably provides both a primary output and at least one secondary output that can be a variant of the primary output which typically drives in-roadway cross-walk lighting. At least one of the secondary outputs is typically configured to allow output of signals for solid flashing and thus not to use the multi-pulsed (flicker) of enhanced lighting. The present device therefore supports coordinated output of both enhanced and non-enhanced outputs for driving different forms of lighting devices.

Figure 7:
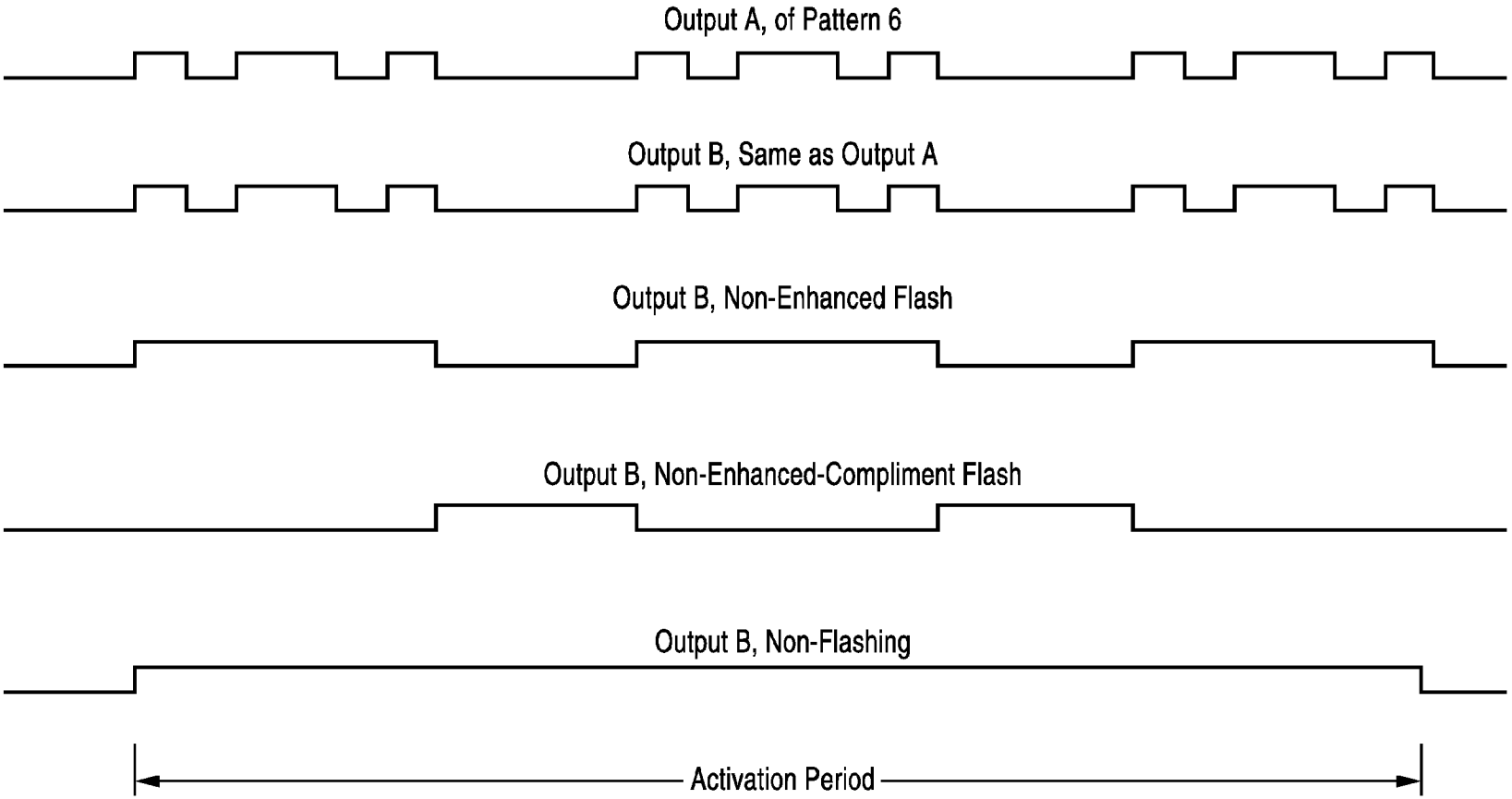
FIG. 7 are digital waveforms for outputs of a cross-walk lighting controller configured with field selectable relationship of output B (secondary) to output A (primary output) according to aspects of the present invention.

FIG. 7 illustrates an example of relationships which can be selected for the secondary lighting output in relation to the primary lighting output during designated activation period. The top signal in the figure depicts a primary lighting pattern in which an enhanced lighting pattern (e.g., pattern 6) is selected. Below that waveform is shown a selection for "B=Primary" (as seen in block 80 of FIG. 4) wherein Output B (Secondary) equals that of Output A (Primary); wherein all the devices coupled to the ECB primary and secondary outputs are supplied with the same lighting pattern. The next timing diagram indicates a selection of "B=NOE" in which the same pattern of Output A (Primary) is used, but without the multi-pulsed flashing of enhanced lighting, wherein solid (non-enhanced) flashing is output. In the fourth signal from the top, a selection of "B=NOEC" is shown in which is the complement of the non-enhanced flash pattern is output on Output B. In this relationship during the activation interval when output A is ON, output B is OFF, and when output A is OFF, then output B is ON (it should be noted that outside of the activation interval both outputs are OFF). It will be appreciated that the complement can be performed in response to programmed output of the CPU or perhaps more preferably in response to a hardware signal inversion. In the bottom signal is shown a selection with "B=Always" or also referred to as "B=Active" in which Output B remains ON for the duration (active period) of the lighting cycle. This mode is valuable for controlling steady lighting, or to provide power to a device that has its own integral flash timing, such as may arise in certain LED street signs and so forth. It will be noted that within this implementation enhanced (multi-pulse) flashing is only output from the secondary output in the case of "B=Primary", and not for "B=NOE", "B=NOEC", or "B=Always".

Figure 8:
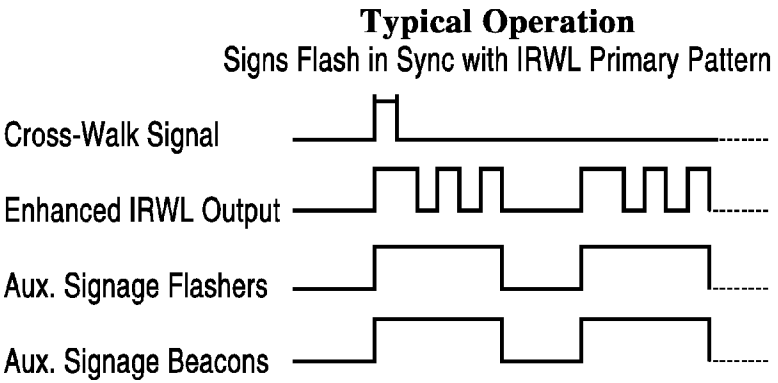
FIGS. 8-10 are digital waveforms illustrating examples of cross-walk lighting being controlled in concert with auxiliary signage according to aspects of the present invention.
Figure 9:
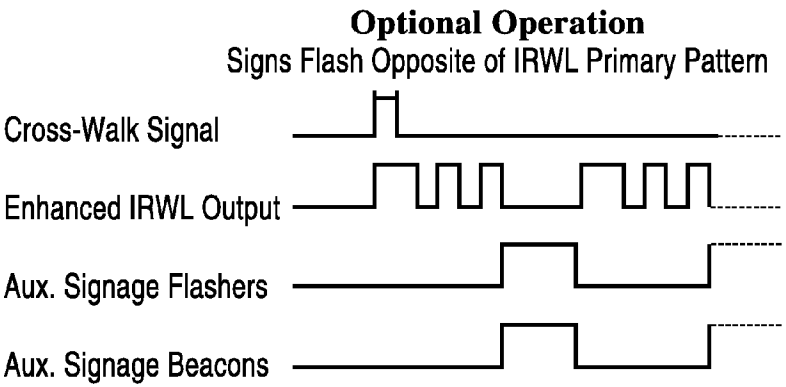
Figure 10:
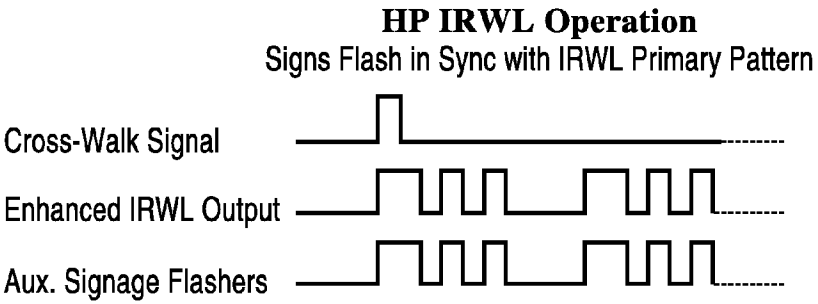

FIGS. 8 through 10 illustrate coordinated control of in-roadway lighting and other lighting associated with the cross-walk. The signals from each of these digital waveform diagrams is discussed from the top signal to the bottom signal. In FIG. 8 a cross-walk signal is shown being received by the ECB circuit, or optionally the signal may be received from a traffic control circuit. A primary output is shown on the next line outputting an enhanced lighting pattern for driving in-roadway lighting, the multiple-pulses in each of the two ON periods are readily seen. The multi-pulse pattern shown is given by way of example and not limitation, as it has been shown the present system allows manual pattern selection, or automatic selection which includes changing the pattern output with each activation. Output from at least one secondary output is then shown for driving additional cross-walk signaling elements, in this case indicating the use of auxiliary signage flashers and beacons. It will be noted that the secondary pattern follows the same ON and OFF timing as the primary signals, but with solid flashing and thus without the enhanced pattern multi-pulse flashing aspect, and is referred to as "B=NOE" as previously discussed. In FIG. 9 the pattern output on the secondary output is "B=NOEC" which outputs a complement, non-enhanced, flashing pattern matching the primary output. It will be noted that the auxiliary signage flashers and beacons are outputting a pattern which is complementary to the in-roadway lighting pattern, this reverse output can be referred to as a "wig-wag" pattern. In FIG. 10 the auxiliary signage flashers are configured to output the same pattern as the in-roadway lighting, which was previously discussed as the secondary pattern selection "B=Primary".

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for controlling cross-walk boundary lighting, comprising:

means for detecting an activation signal for a cross-walk configured with cross-walk boundary lighting;

means for selecting a different enhanced flashing pattern, from a plurality of patterns stored in the apparatus, for each successive activation of the cross-walk boundary lighting;

wherein said enhanced flashing pattern comprises the output of multiple pulses of light during each ON portion of flashing pattern;

means for changing one or more lighting output signals, including a primary lighting output, responsive to said selecting of an enhanced flashing pattern;

means for determining that an activation period for the cross-walk boundary lighting has expired; and means for deactivating said one or more lighting output signals at the expiration of said activation period.

2. An apparatus as recited in claim 1, further comprising means for changing one or more secondary lighting outputs which are synchronized with and have a field selectable relationship with said primary lighting output.

3. An apparatus as recited in claim 1, wherein said means for detecting an activation signal for a cross-walk is configured to receive input from a push-button or other active cross-walk activation device, or from a passive cross-walk activation device, or by receiving an activation signal from a control unit configured for controlling traffic control signaling.

4. An apparatus as recited in claim 1, wherein said enhanced flashing pattern is configured to output from two to five light pulses during the ON portion of the flashing pattern.

5. An apparatus for controlling cross-walk boundary lighting, comprising:

a cross-walk lighting control module configured for receiving a cross-walk lighting activation signal;

said cross-walk lighting control module configured with at least one output signal for driving the activation of lighting along the path of the cross-walk;

said cross-walk lighting control module comprising a computer and memory adapted for storing and executing programming adapted for, selecting a different flashing pattern, from a plurality of internally stored enhanced lighting patterns, for each successive activation of cross-walk lighting, changing one or more lighting output signals responsive to said selected pattern, and deactivating said one or more lighting output signals at the termination of said selected pattern.

6. An apparatus as recited in claim 5, wherein said cross-walk lighting activation signal originates from active or passive pedestrian selection, or from receiving an activation signal from a control unit configured for controlling traffic control signaling.

7. An apparatus as recited in claim 5:

wherein said flashing pattern comprises ON and OFF periods for light outputs; and wherein an enhanced lighting mode generates up to five flashes of multi-pulsed flashing during one or more of the ON intervals.

8. An apparatus as recited in claim 5, wherein said enhanced flashing pattern is selected sequentially from a plurality of patterns stored within said cross-walk lighting control module.

9. An apparatus as recited in claim 5:

wherein said flashing pattern is selected according to a randomized selection, from a plurality of patterns stored within said cross-walk lighting control module; and wherein said selection is random or based on a pseudo random pattern.

10. An apparatus as recited in claim 9, further comprising preventing the output of patterns which have been recently used and making a new selection in response thereto.

11. An apparatus as recited in claim 5, further comprising outputting of a secondary flashing pattern during said activation duration.

12. An apparatus as recited in claim 11, wherein a pattern relationship between said secondary flashing pattern to said primary flash pattern can be selected.

13. An apparatus as recited in claim 12, wherein the relationship between said secondary flashing pattern and said primary output is selected from the group of relationships consisting of an identical pattern, a non-enhanced version (NOE), a complemented non-enhanced version (NOEC), and remaining on while said primary patterns are being output.

14. An apparatus as recited in claim 5:

wherein said cross-walk boundary lighting comprises flush mounted in-roadway lights; and wherein said cross-walk lighting control module simultaneously outputs secondary signals with a field selectable relationship with the primary output for controlling additional beacons and/or flashing signs.

15. A method of controlling cross-walk boundary lighting, comprising:

detecting a cross-walk activation request;

selecting a different enhanced flashing pattern for each successive cross-walk activation;

wherein said enhanced flashing pattern comprises the output of multiple pulses of light during the ON portion of the flashing pattern.

wherein said enhanced flashing pattern is selected from a plurality of enhanced flashing patterns retained within a cross-walk lighting controller;

outputting said enhanced flashing pattern as an output sequence, from at least a primary lighting output, to control the state of cross-walk boundary lighting;

determining that an activation period for cross-walk boundary lighting has expired; and deactivating cross-walk boundary lighting in response to the expiration of said activation period.

16. A method as recited in claim 15, wherein said enhanced flashing pattern is configured to output from approximately two to five light pulses during the ON portion of the light cycle.

17. A method as recited in claim 15, wherein said cross-walk lighting activation signal originates from active or passive pedestrian selection, or by receiving an activation signal from a control unit configured for controlling traffic control signaling.

18. A method as recited in claim 15:

wherein said selecting of the enhanced flashing pattern is performed sequentially or randomly from a plurality of patterns stored within a cross-walk lighting control module; and wherein if the most recently output enhanced flashing pattern is selected then another selection is made, so that the same pattern is not output twice in succession.

19. A method as recited in claim 15, further comprising outputting of a secondary flashing pattern from a secondary lighting output during said activation duration.

20. A method as recited in claim 19:

wherein a pattern relationship between said secondary lighting output and said primary lighting output can be selected; and wherein the relationship between said secondary lighting output and said primary lighting output is selected from the group of relationships consisting of an identical pattern, a non-enhanced version (NOE), a complemented non-enhanced version (NOEC), and a steady output which remains on while said primary output is active.

* * * * *